US008656535B1

(12) United States Patent
Adorney

(10) Patent No.: US 8,656,535 B1
(45) Date of Patent: Feb. 25, 2014

(54) RAPID BEDDING SYSTEM AND METHOD

(76) Inventor: Kathryn M. Adorney, Chestnut Ridge, NY (US)

( * ) Notice: Subject to any disclaimer, the term of this patent is extended or adjusted under 35 U.S.C. 154(b) by 0 days.

(21) Appl. No.: 13/341,581

(22) Filed: Dec. 30, 2011

(51) Int. Cl.
*A47C 21/02* (2006.01)
*A47G 9/02* (2006.01)
*A47G 9/04* (2006.01)
*A47C 31/00* (2006.01)

(52) U.S. Cl.
USPC ..... 5/498; 5/495; 5/496; 5/497; 5/499

(58) Field of Classification Search
USPC ..... 5/495–500
See application file for complete search history.

(56) References Cited

U.S. PATENT DOCUMENTS 3,965,504 A * 6/1976 Ainsworth ..... 5/485
4,922,565 A * 5/1990 Blake ..... 5/484
5,008,966 A * 4/1991 Lepow ..... 5/496
5,086,530 A * 2/1992 Blake ..... 5/484
5,566,411 A * 10/1996 Eiler ..... 5/494
5,732,424 A 3/1998 Bond
5,901,389 A 5/1999 Manner
6,237,171 B1 5/2001 Allen
6,286,162 B1 9/2001 Huart
6,859,962 B2 * 3/2005 Diak/Ghanem ..... 5/499
8,032,959 B2 * 10/2011 Rowson et al. ..... 5/496
2003/0000014 A1 1/2003 Sopher
2003/0177579 A1 9/2003 Diak/Ghanem
2007/0000053 A1 * 1/2007 Yang ..... 5/493

FOREIGN PATENT DOCUMENTS

FR 2675680 A1 * 10/1992 ..... A47G 9/02

* cited by examiner

*Primary Examiner* — William Kelleher
*Assistant Examiner* — Eric Kurilla
(74) *Attorney, Agent, or Firm* — W. Patrick Quast, Esq.

(57) ABSTRACT

A rapid bed making system and method includes a first sheet for securing to a mattress and a "T" shaped second sheet. Cooperating releasable fasteners are affixed to the top surface of the first sheet and to the bottom surface of a first panel of the second sheet. After the first panel of the second sheet is aligned and pressed together with the top surface of the first sheet, a second confluent panel of the second sheet sized to be the same length as the first panel, and with left and right side mattress overlay extensions, is brought up and over the first panel. The first sheet remains in place. The "T" shaped sheet is removed for washing and subsequent reinstallation. Sheet changing of bunk beds and beds with limited access to one or more sides is simplified especially for the elderly and/or disabled.

5 Claims, 2 Drawing Sheets

RAPID BEDDING SYSTEM AND METHOD

This invention relates to bedding systems, and more particularly to bedding systems wherein there is limited access to one or more areas of the bed such as pertains with a typical bunk bed, daybed, and platform bed.

BACKGROUND OF THE INVENTION

The making of a bed is, of course, a chore known and underappreciated by just about everyone. The process is typically monotonously the same. First a fitted sheet is secured to a mattress, then a second sheet is tucked into the base and sides of the mattress. Pillows, blankets, and comforters complete the arrangement. And when sheets become soiled the process must be repeated again and again.

Many attempts have been made to improve the process as is evident from the following patents. For example, U.S. Pat. No. 5,901,389 discloses a "Bed Sheet". The patent teaches connecting a portion of a top sheet 12 (FIG. 1) and a bottom sheet 14 (FIG. 1) together for placement on a mattress, "whereby said mattress cover is suited for use on a bed positioned against a wall because said top sheet is automatically installed on the mattress when said bottom sheet is secured to the mattress, and said second side edge of said top sheet requires little or no manual tucking either underneath the mattress or between the mattress and the wall", col. 5, claim 1.

U.S. Pat. No. 5,732,424 discloses a "Bedding Arrangement". The patent teaches a removable mattress cover 10 being releasably secured to a mattress (FIG. 2). A rectangular insulated cover 12 (FIG. 1) being releasably secured to said mattress, and a sheet or folder 20 (FIG. 3) with fastener means cooperating with said insulated cover so that "[w]hen it is desired to change the liner or sheet panels, they are easily detached from the releasable fastener means of the mattress cover and covering, an operation which does not require access to the rear side of the bed", col. 2, lines 16-20.

U.S. Patent No. 2003/0000014 A1 discloses an "Easy-Change Mattress Safety Sheet System". The patent teaches a bottom base sheet 8 (FIG. 2) and a removable top sheet 9 (FIG. 2) for covering a mattress "attached by simple attaching means", paragraph [0021]. "The simple attaching means can be . . . a zipper, Velcro, or a plurality of snaps", paragraph [0023].

U.K. Patent Application No. 2,672,607 A discloses "Bed Clothing". The application discloses a blanket 10 with an underlayer 12 being releasably secured to a mattress 16 via pockets 14 at each corner of the underlayer. The underlayer is permanently secured at one end 20 to a substantially same sized upper layer 18.

U.S. Pat. No. 6,286,162 B1 discloses "Bedding Elements". The patent teaches "T" shaped first and second main piece covers for bedding elements 102R and 103R (FIG. 1) which when combined can secure one or more comforters. Flaps 117 with detachable contact means can secure the cover to a mattress.

U.S. Patent No. US 2003/0177579 A1 discloses a "Quick Change Bed Sheet Set". The patent teaches enclosing a mattress 100 in a bottom sheet 20 and a top sheet 30 with a waterproof panel 40 positioned in between (FIG. 1). The top and bottom sheets are releasably secured using zippers, button holes, snaps or Velcro (paragraph [0032]). The waterproof panel and upper sheet can be removed for cleaning while leaving the lower sheet in place connected to the mattress.

U.S. Pat. No. 6,237,171 B1 discloses a "Bed Sheet And Blanket Combination For Accommodating Differing Sleeper Preferences". The patent teaches a bed sheet and blanket combination wherein half of a queen or king sized bed sheet contains a pocket for securing a blanket for use when needed for warmth. The Blanket is easily removed when the bed sheet is washed. The pocket within the bed sheet can be releasably affixed in a variety of ways, including hook and loop fasteners such as Velcro.

While the above noted patents describe useful devices and methods for dealing with this housekeeping routing, they do not envision the simplicity and ease of use the invention detailed below provides for the extremely wide variety of applications that can and do pertain.

It is therefore a primary object of the present invention to provide a rapid bedding system.

A further object of the invention is to provide a rapid bedding system wherein the removal of top and bottom sheets is accomplished in one step.

An additional object of the invention is to provide a rapid bedding system wherein a soiled sheet is removed without walking around the bed.

Still another object is to provide a rapid bedding system wherein a soiled sheet is removed without lifting the mattress.

Yet another object is to provide a rapid bedding system wherein in the case of a bunk bed, clean sheets can be applied without lifting the mattress or climbing onto the mattress.

An additional object is to provide a rapid bedding system wherein a top and bottom sheet can be applied in one step.

A further object is to provide a rapid bedding system wherein changing the bed sheets can be done with little strength and/or finger dexterity, a feature especially helpful to the disabled and/or elderly.

SUMMARY OF THE INVENTION

These and other objects are obtained with the rapid bedding system and method of the present invention.

As briefly noted above changing the sheets on a bed is an area clearly in need of improvement. This becomes extremely clear when dealing with bunk beds having at least one side against a wall, or day beds where the mattress is enclosed by a frame that extends above the top edge of the mattress on three sides, or when dealing with disability or the elderly.

Typically a standard bed sheet exchange requires removing a soiled top sheet, then removing the soiled bottom sheet which involves unhooking the fitted covers at the four corners of the bed. In the case of a top bunk bed climbing onto the top bunk and reaching behind the bed frame, then unhooking each corner, and then climbing down from the bunk to remove the bottom, fitted sheet is needed.

Then putting a clean, fitted sheet onto the mattress involves walking around the bed to each corner to place the fitted corner of the sheet onto the corner of the bed. The fourth and last corner is the most difficult because the fitted sheet is designed to fit snugly and therefore the mattress must be lifted in order to pull the fitted corner around the fourth corner of the bed. In this case of a top bunk bed it involves climbing onto the mattress, lifting the mattress while kneeling on it, and hooking the fitted corner around the mattress corners.

Finally the last step involves placing a clean, flat sheet on the top of the bed which requires lifting the mattress with one hand and tucking the sheet under the mattress with the other. When tucking in the top sheet of a top bunk one must climb onto the bunk bed to reach the far corner, lift the mattress while kneeling on it, and slide the sheet under with the other hand.

As is clear from the above it occurred that the most difficult sheet changing procedure is putting a fitted sheet on the mattress, and, of course, removing it when soiled. To solve this problem a first sheet has been developed which simply stays in place, fitted to the mattress, much like a mattress pad. The top surface is equipped with releasable connectors which can be selected from a variety of fasteners such as buttons and holes, snap fittings, or hook and loop fasteners such as Velcro. In this application Velcro has been found to be particularly well adapted.

To complete the rapid bedding system of the invention a second changeable bed sheet has been devised, consisting of an inverted "T" shaped sheet which serves as the bottom sheet and top sheet combined. This second sheet can be considered to consist of two confluent panels, the first panel being identical to the bed surface (i.e. the top surface of the mattress) in width and length, with a confluent second panel being substantially the same in length as the first panel, with additional left and right side width extensions for covering the mattress side walls, and for tucking under the mattress if required.

The bottom surface of the first panel section of the changeable bed sheet is equipped with matching cooperating releasable fasteners to that employed on the top surface of the first sheet fitted to the mattress. As noted above, Velcro fasteners have been found especially well suited to this application.

To make a bed using the rapid bedding system of the invention the first sheet is affixed to the mattress in the usual manner, but this chore need be done perhaps every few months, as is the case with a mattress pad. The second sheet is laid over the first sheet with the cooperating releasable fasteners in alignment (e.g. Velcro strips), pressure is applied (in the case of the Velcro strips), and the top portion of the second sheet is brought up so that the top end is at the head of the bed. To strip the bed, the second sheet is simply pulled off of the bed.

DETAILED DESCRIPTION OF THE PREFERRED EMBODIMENTS

Figure 1:
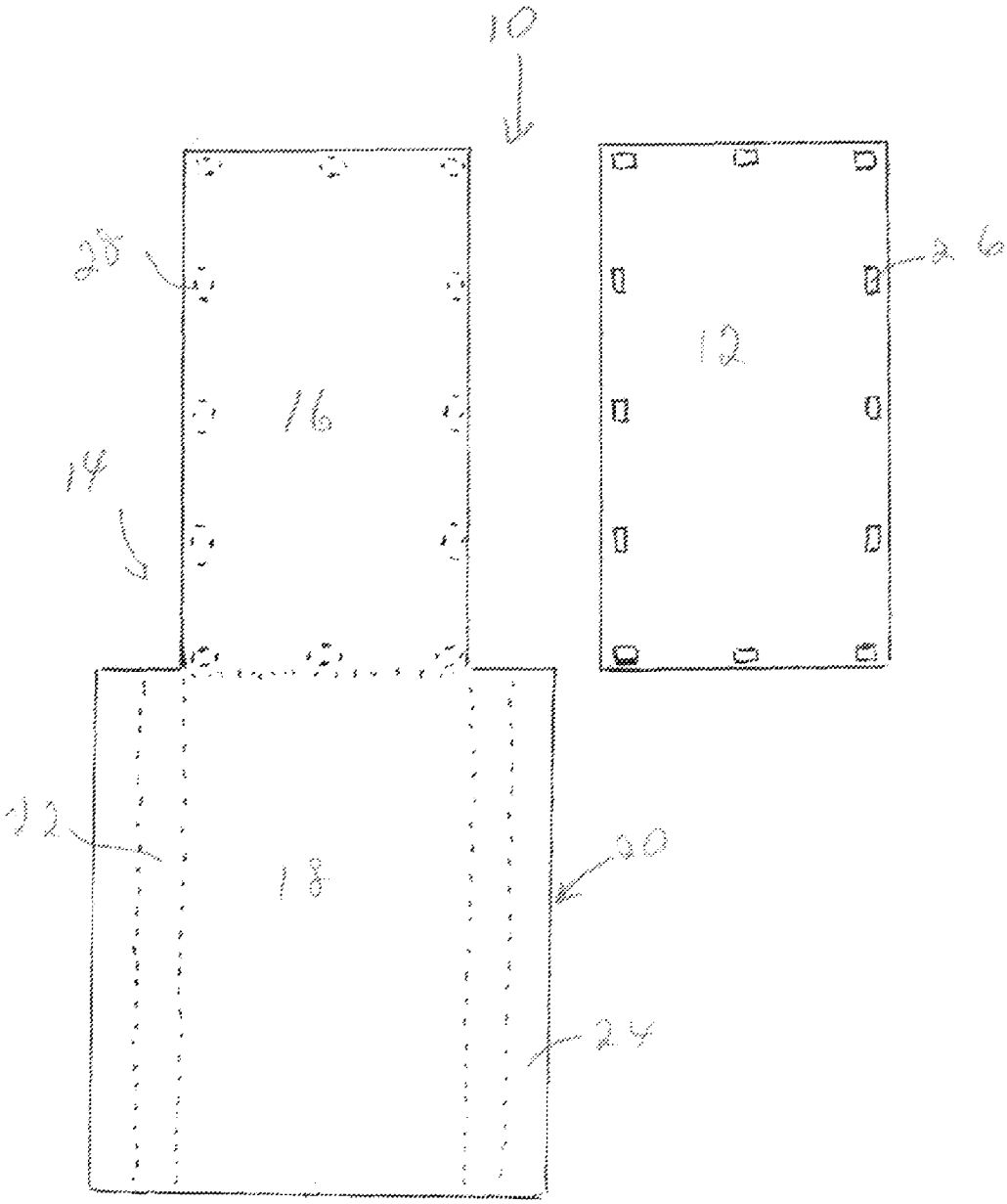
FIG. 1 is a top plan view of both the first sheet and the second sheet of the present invention prior to utilization upon a mattress.
Figure 2:
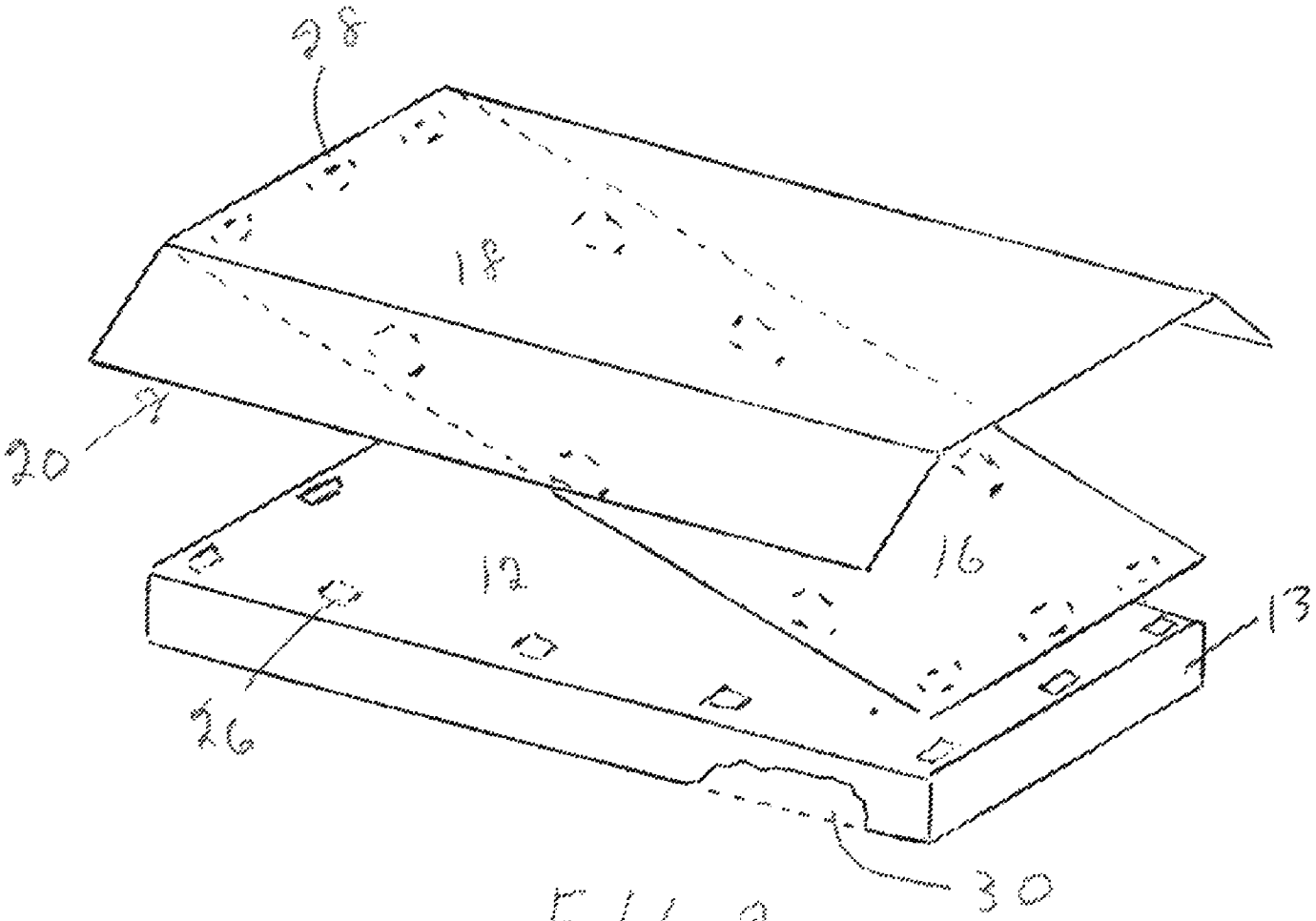
FIG. 2 is a perspective view of the first sheet having been secured to a mattress and the second sheet in position to be affixed to the first sheet making use of cooperating releasable fasteners, such as Velcro strips.

Turning now to the drawings wherein similar items having the same function are denoted with the same numerals, in FIG. 1 both the first sheet 12 and the generally "T" shaped second sheet 14, which combine to form the present invention 10 of a rapid bedding system, are depicted in top plan view prior to the procedure of making a bed. First sheet 12 is generally rectangular in shape, and has a series of Velcro strips 26 affixed to its top surface for cooperative releasable engagement with a matching series of Velcro strips 28 affixed to the second sheet which will be further discussed below. Other types of releasable fasteners, such as buttons and holes, zippers, and snaps, could also be employed. As best seen in FIG. 2 the base sheet 12 has a mattress sidewall and tuck under portion 13.

The second sheet 14 comprises a first panel 16 and a confluent second panel 18. The first panel 16 is sized and configured to substantially conform to the length and width of the top surface of the mattress. The bottom surface of the first panel, which in operation will be placed directly over and in alignment with the first sheet, contains matching Velcro strips 28 to those affixed to the top surface of the first sheet.

The second panel 18 of the second sheet is substantially the same length as the first panel 16, with the addition of left and right mattress overlap extensions 20 perpendicular to and extending a spaced distance from the left and right sides of the first panel. A first portion 22 of the left and right extensions 20 are for the purpose of covering a mattress sidewall, while a second portion 24 of the left and right extensions 20 can be utilized as a mattress tuck under if required.

In FIG. 2 the first sheet 12 is shown fitted onto a typically rectangularly shaped mattress 30, with its mattress sidewall overlap 13 secured in place. The second sheet 14 is depicted positioned above the first sheet covered mattress, with the first panel 16 of the second sheet placed above and in alignment with the first sheet. The second panel 18 is shown already brought up and over the first panel 16 in the direction of what now would be considered the head of the bed.

To make a bed an operator would first secure the fitted first sheet 12 to the mattress, then align the fist panel 16 of the second sheet 14 over the first sheet 12 and press the Velcro strips 28 of the first panel of the second sheet 16 together with the matching Velcro strips 26 of the first sheet 12. Finally, the second panel 18 of the second sheet 14, which is secured to the mattress via Velcro strips 28 and 26, and therefore does not require to be tucked under the mattress, is brought up so as to cover the top surface of the first panel.

To strip a bed using the rapid bedding system of the invention the first sheet 12 would normally stay in place on the mattress for a considerable period of time, as, for example, as would a mattress pad. Therefore stripping soiled sheets off of a bed would now simply involve releasing the Velcro strip secured second sheet from the bed.

While the present invention has been disclosed in connection with versions shown in detail, various modifications and improvements will become readily apparent to those skilled in the art. Accordingly, the spirit and scope of the present invention is to be limited only by the following claims.

What is claimed is:

1. A rapid bed making system for application upon a rectangular bed assembly, including a rectangularly shaped mattress, having a head end, a bottom end, and first and second sides, the mattress having a top surface, comprising:

(a) a first sheet, having a top surface and a bottom surface said first sheet sized and configured so as to cover at least the top surface of the mattress, said bottom surface in contact with the top surface of the mattress when said first sheet is in place on the mattress;

(b) a second sheet, said second sheet comprising a confluent first panel and second panel, said first panel having a top surface and a bottom surface, said first panel being sized to substantially conform in width and length to the top surface of the mattress, said first and second panels having a respective head end and bottom end, said second panel having approximately the same length as said first panel, said second panel being confluent with said first panel along a line of confluence at their respective bottom ends, said second panel of said second sheet further including at least one of a left and right mattress overlap extension portions extending the length of said second panel and extending perpendicular to, and a spaced distance beyond, the width of said first panel of said second sheet, each of said left and right mattress overlap extension portions including a first portion extending the length of said second panel for covering a mattress sidewall and a second portion extending the length of said first portion and extending perpendicular to and beyond said first portion, said second portion to be utilized as a mattress tuck-under portion if required; and (c) said top surface of said first sheet having a first set of connecting means disposed thereon and said bottom surface of said first panel of said second sheet having a second set of connecting means disposed thereon, said first and second set of connecting means affixed at approximately the same spaced distance from the respective peripheral edges of said first sheet, and said peripheral edges of said second sheet, said system further requiring the alignment and affixing of said first and second set of connecting means together by an operator, such that when the operator aligns and affixes said first panel of said second sheet to said first sheet utilizing said first and second set of connecting means, the first panel is retained in fixed relationship above the first sheet, and when the operator raises said second panel of said second sheet over said first panel of said second sheet, the second sheet will crease at approximately said line of confluence so that said respective top ends of said first and second panels will approximately align at the completion of the bed making procedure with said second panel disposed on top of said first panel and on top of the top surface of said first sheet and the top surface of the mattress, said first and second set of connecting means adapted to be detachably connected from one another so as to allow the operator to install and remove said second sheet from said first sheet without the need to lift the mattress in any way, said at least one of said left and right mattress overlap portions disposed in the operator's discretion in a downward direction so as to overlap a respective one of the first and second sides of the mattress and, if desired, all or part of said second portion tucked under the mattress.

2. The rapid bed making system according to claim 1 wherein said first sheet is further configured and sized so as to cover at least a portion of said head end, said bottom end, and said first and second sides of said mattress.

3. The rapid bed making system according to claim 1 wherein said connecting means affixed to said top surface of said first sheet and said bottom surface of said first panel of said second sheet are strips of hook and loop fasteners.

4. A method for rapidly making a bed, comprising the steps of:

(a) affixing a first sheet to at least a top surface of a rectangularly shaped mattress having a head end, a bottom end, and first and second sides;

(b) securing cooperating releasable fasteners to a top surface of said first sheet;

(c) creating a second sheet, said second sheet comprising a first panel sized to substantially conform in width and length to said top surface of said mattress, and a confluent second panel having approximately the same length as said first panel of said second sheet, said second panel of said second sheet further including at least one of a left and right mattress overlap extension portions extending the length of said second panel and extending perpendicular to, and a spaced distance beyond, the width of said first panel of said second sheet, each of said left and right mattress overlap extension portions including a first portion extending the length of said second panel for covering a mattress sidewall and a second portion extending the length of said first portion and extending perpendicular to and beyond said first portion, said second portion to be utilized as a mattress tuck-under portion if required;

(d) securing matching cooperating releasable fasteners to those affixed to said top surface of said first sheet to a bottom surface of said first panel of said second sheet; and (e) having an operator align said bottom surface of said first panel of said second sheet over said top surface of said mattress, and connect said cooperating releasable fasteners on said top surface of said first sheet to said cooperating releasable fasteners on said bottom surface of said first panel of said second sheet without the need to lift the mattress in any way, and lift said second panel of said second sheet up and over said first panel of said second sheet so as to cover the top surface of said first panel of said second sheet, thereby making said bed, said matching cooperating releasable fasteners adapted to be detachably connected from one another so as to allow an operator to remove said second sheet from said first sheet without the need to lift the mattress in any way;

(f) at the operator's discretion disposing said at least one of said left and right mattress overlap portions in a downward direction so as to overlap a respective one of the first and second sides of the mattress and, if desired, tucking all or part of the respective said second portion under the mattress.

5. The method of rapidly making a bed according to claim 4 wherein said cooperating releasable fasteners affixed to both said top surface of said first sheet and said bottom surface of said first panel of said second sheet are strips of hook and loop fasteners.

* * * * *